US005719353A

United States Patent [19]

Carlson et al.

[11] Patent Number: 5,719,353

[45] Date of Patent: Feb. 17, 1998

[54] MULTI-JACKETED COAXIAL CABLE AND METHOD OF MAKING SAME

[75] Inventors: Bruce J. Carlson, Hickory; David H. Pixley, Newton; James L. Sorosiak, Charlotte, all of N.C.

[73] Assignee: Commscope, Inc., Catawba, N.C.

[21] Appl. No.: 490,062

[22] Filed: Jun. 13, 1995

[51] Int. Cl.[6] ..... H01B 7/18

[52] U.S. Cl. ..... 174/28; 174/102 P; 174/105 R; 174/107; 174/110 PM; 174/112

[58] Field of Search ..... 174/107, 112, 174/36, 109, 102 P, 105 R, 110 PM, 28

[56] References Cited

U.S. PATENT DOCUMENTS

| | | | |
|---|---|---|---|
| 2,169,108 | 8/1939 | Meybauer | 174/107 |
| 3,031,523 | 4/1962 | Howard | 174/102 |
| 3,551,586 | 12/1970 | Dembiak | 174/107 |
| 3,748,371 | 7/1973 | Krook et al. | 174/70 R |
| 3,790,697 | 2/1974 | Buckingham | 174/102 |
| 4,041,237 | 8/1977 | Stine et al. | 174/36 |
| 4,237,337 | 12/1980 | Serrander | 174/70 R |
| 4,360,704 | 11/1982 | Madry | 174/36 |
| 4,514,036 | 4/1985 | McDonald | 174/107 |
| 4,600,805 | 7/1986 | Glynn et al. | 174/102 R |
| 4,719,319 | 1/1988 | Tighe, Jr. | 174/109 |
| 4,731,504 | 3/1988 | Achille et al. | 174/107 |
| 5,107,076 | 4/1992 | Bullock et al. | 174/107 |
| 5,173,961 | 12/1992 | Chiasson | 385/113 |
| 5,208,426 | 5/1993 | Kennedy et al. | 174/36 |
| 5,262,592 | 11/1993 | Aldissi | 174/36 |
| 5,274,712 | 12/1993 | Lindsay et al. | 174/36 |
| 5,321,202 | 6/1994 | Hillburn | 174/36 |
| 5,329,064 | 7/1994 | Tash et al. | 174/36 |
| 5,371,484 | 12/1994 | Nixon | 174/28 |
| 5,414,213 | 5/1995 | Hillburn | 174/36 |
| 5,416,269 | 5/1995 | Kemp et al. | 174/107 |
| 5,521,331 | 5/1996 | Hillburn | 174/36 |

FOREIGN PATENT DOCUMENTS 2049263 12/1980 United Kingdom .

*Primary Examiner*—Kristine L. Kincaid
*Assistant Examiner*—Marc D. Machtinger
*Attorney, Agent, or Firm*—The Bell Zeltzer Intellectual Property Law Group of Alston & Bird, LLP

[57] ABSTRACT

A reinforced coaxial cable for underground service is disclosed. The cable generally includes an elongate center conductor, a surrounding dielectric material such as a foamed polymer dielectric, an outer conductor, a first jacket, an intermediate protective layer, and a second jacket. A ripcord can be positioned longitudinally between the first jacket and the intermediate protective layer to facilitate removal of both the intermediate protective layer and the second jacket. A tracer, or other visible indicia, extends longitudinally along the outer surface of the second jacket to facilitate locating the underlying ripcord. The intermediate layer and the second jacket provide increased impact resistance, cut-through resistance, and compressive strength, as well as increased resistance to abrasion and other frictionally induced damage. In addition, the intermediate layer and second jacket can be readily removed to allow increased flexibility or connectorization of the cable.

23 Claims, 2 Drawing Sheets

MULTI-JACKETED COAXIAL CABLE AND METHOD OF MAKING SAME

FIELD OF THE INVENTION

This invention relates generally to coaxial cable and associated fabrication methods and, more particularly, to a structurally reinforced coaxial cable and associated fabrication methods.

BACKGROUND OF THE INVENTION

A conventional coaxial cable typically includes a center conductor, a dielectric layer surrounding the center conductor, a foil shield layer surrounding the dielectric, a braided wire covering surrounding the foil shield, and an outer protective plastic jacket. See, for example, U.S. Pat. No. 4,894,488 to Gupta and U.S. Pat. No. 4,701,575 to Gupta et al., both of which are assigned to the assignee of the present invention and are incorporated herein by reference in their entirety.

Coaxial cable is typically installed aerially or underground. In either type of installation, coaxial cable should have sufficient impact resistance, cut-through resistance, and compressive strength to permit bending and to withstand stresses encountered during normal handling and installation. For example, aerial installation of a coaxial cable generally requires passing the cable around one or more rollers as the cable is strung on utility poles. During and following installation, the cable may, therefore, be subjected to tensile and bending stresses which may result in serious damage to the cable. Such damage may destroy the mechanical integrity of the cable and introduce the possibility of contamination from moisture ingress.

Coaxial cable transmission systems generally include two primary types of coaxial cables. A first type includes trunk and distribution (T&D) cables which are adapted to span relatively long lengths so as to effectively serve as feeder cables for the transmission system. For example, a T&D cable can extend from a central office or head end to one or more nodes. A second type includes coaxial drop cable which typically extends between a cable tap, at which point the drop cable is connected to a T&D cable, and a customer of the transmission system. Although T&D coaxial cables are generally larger than coaxial drop cables, both types of cables can be installed either aerially or underground.

Underground installation, both directly within the ground and indirectly within a conduit, may subject a coaxial cable to additional hazards such as abrasion during pulling, impact from various objects, and degradation from moisture. Buried cable is particularly susceptible to being cut during underground installation by various objects including rocks and glass, since the cable is often times pulled directly over these sharp objects. Buried cable is also vulnerable to impact from various objects, such as shovels and other digging equipment, which may damage or cut the cable. As known to those having skill in the art, the damage occasioned by cuts or impacts can allow moisture to seep from the ground into the cable and degrade its performance. Cable buried within an underground conduit may be exposed to further hazards, such as abrasion and other friction-induced stresses since the cable is typically pulled through the conduit.

As a result, cable manufacturers have tried to address the problems associated with underground installation by increasing the thickness of the outer protective jacket of the cable. Unfortunately, the existing designs decrease the flexibility of coaxial cable, making it difficult to route the cable within confined areas such as electrical vaults and pedestals, in which the coaxial cable must often times be sharply turned and twisted in order to establish a proper connection. Furthermore, coaxial cable is typically terminated, such as within a pedestal, with a jacket-gripping connector. These connectors generally have standard sizes. By increasing the thickness of the outer jacket in order to further protect the coaxial cable, standard size jacket gripping connectors cannot be used. Thus, non-standard connectors must be designed and installed, thereby increasing the cost and complexity of the coaxial cable system and the time required for installation.

SUMMARY OF THE INVENTION

It is therefore an object of the present invention to provide an improved coaxial cable that is impact and cut resistant during and following underground installation.

It is another object of the present invention to provide an improved coaxial cable that is resistant to abrasion and other friction-induced stresses.

It is yet another object of the present invention to provide an improved coaxial cable having increased flexibility relative to a coaxial cable having a protective jacket of increased thickness.

These and other objects are provided according to one aspect of the present invention by a coaxial cable comprising at least one elongate conductor, a dielectric material surrounding and adjacent the elongate conductor, an outer conductor surrounding and adjacent the dielectric material, and a composite protective jacket. The composite protective jacket comprises an inner protective layer of a first material surrounding and adjacent the outer conductor, an intermediate layer of a second material surrounding and removably adjacent the inner protective layer, and an outer protective layer of a third material surrounding and adjacent the intermediate layer. An adhesive layer may be disposed between the intermediate layer and the outer layer.

The second material has a higher melting temperature than the third material, such that the first and third materials of the inner and outer protective jackets, respectively, form distinct separate phases from each other. Accordingly, the inner and outer protective jackets can be readily separated and the outer protective jacket can be removed to permit the installation of standard connectors to end portions of the cable and to increase the flexibility of the cable. The first and third materials may be the same material, such as polyethylene. The impact resistance of the second material, typically a polyester such as MYLAR® Polyester, is preferably greater than the impact resistance of the first and third materials to thereby further protect the elongate conductor, the outer conductor, and the dielectric material from damage.

In one advantageous embodiment, the intermediate layer may comprise opposing first and second longitudinal edge portions overlapping to define a longitudinally extending seam. The coaxial cable of the present invention can also include a longitudinally extending ripcord to facilitate the removal of the intermediate layer and the outer protective layer. The ripcord may be disposed between the inner protective layer and the intermediate layer and may be aligned with the longitudinally extending seam of the intermediate layer. The outer layer may further comprise visible indicia for indicating the position of the underlying ripcord. The visible indicia may extend longitudinally along the outer surface of the outer layer.

The intermediate layer and the outer layer provide increased impact resistance, cut-through resistance, and compressive strength, as well as increased resistance to abrasion and other frictionally induced damage. In addition, the intermediate layer and outer layer can be readily removed to allow increased flexibility or connectorization of the cable.

According to another aspect of the present invention, a method for producing a coaxial cable comprises the steps of advancing a coaxial cable core, typically comprised of at least one elongate conductor, a dielectric material surrounding and adjacent the elongate conductor, and an outer conductor surrounding and adjacent the dielectric material, along a path of travel, and forming an inner protective layer of a first material around and adjacent the advancing coaxial cable core, such as by extruding the first material thereabout. A ripcord can then be disposed longitudinally along an outer surface of the inner protective jacket, a removable intermediate layer of a second material can be formed around and adjacent the inner protective layer and the longitudinally disposed ripcord, and an outer protective layer of a third material can be formed, such as by extrusion, around and adjacent the intermediate layer. Typically, the intermediate layer is formed either by extrusion or by wrapping a tape of the second material about the inner protective layer and the ripcord. In embodiment in which the intermediate layer is formed by wrapping a tape about the inner protective layer and the ripcord, the longitudinal edge portions of the intermediate layer can be overlapped to define a longitudinally extending seam aligned with and overlying the ripcord. Additionally, the method may comprise the step of forming visible indicia on the outer surface of the outer protective layer for indicating the position of the underlying ripcord.

The inner protective layer is shielded from excessive heat during the step of forming an outer protective layer by using an intermediate protective layer having a higher melting temperature than the melting temperature of the outer protective layer. As a result, the inner and outer protective jackets form distinct separate phases from each other. Accordingly, the intermediate protective layer and the outer protective jacket can be readily removed from the inner protective jacket to increase the flexibility of the cable and to facilitate connectorization of the cable.

DETAILED DESCRIPTION OF PREFERRED EMBODIMENTS

Figure 1:
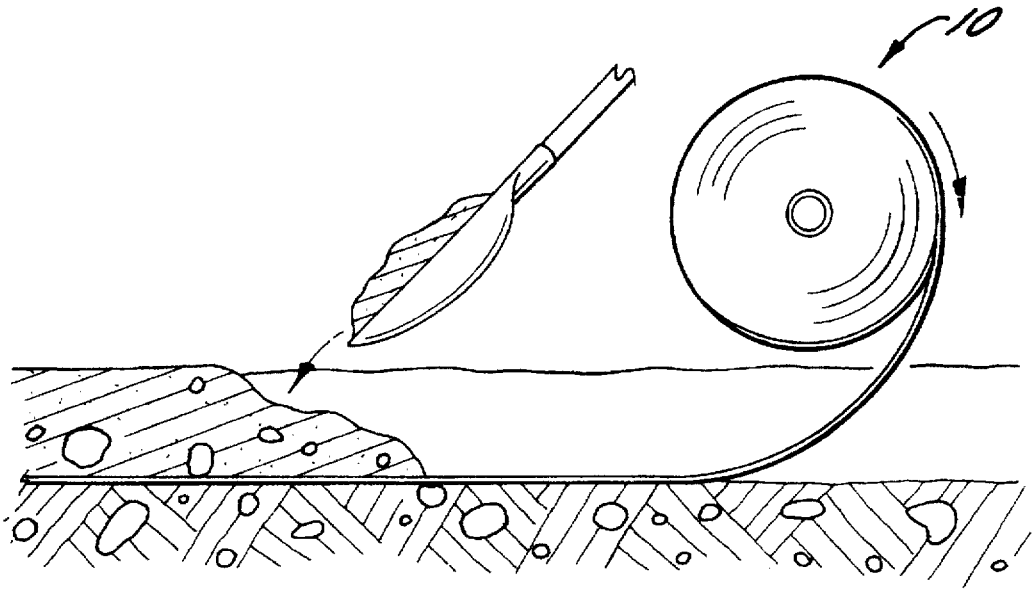
FIG. 1 illustrates a coaxial cable being buried directly underground in a rocky terrain.
Figure 2:
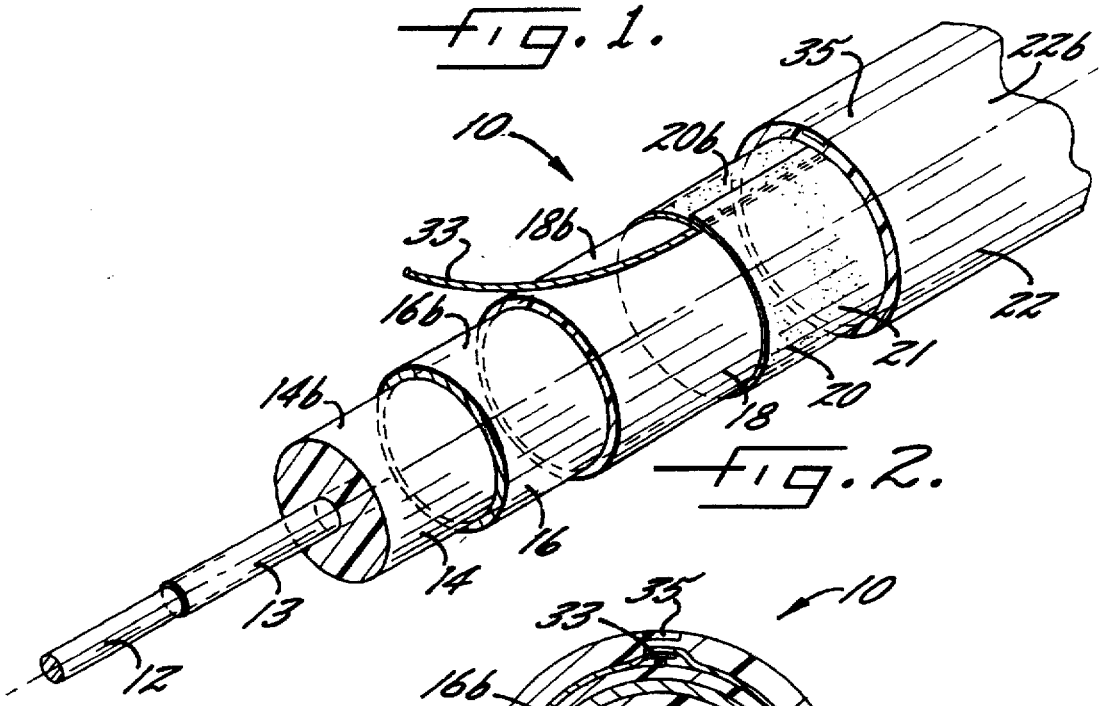
FIG. 2 is a perspective view of a coaxial cable according to one embodiment of the present invention, with portions of the coaxial cable removed for clarity of illustration.
Figure 3:
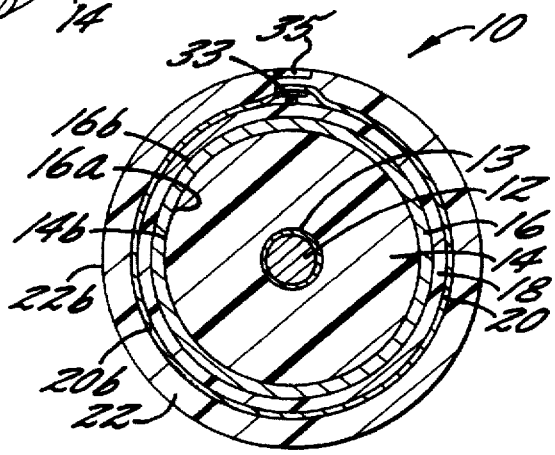
FIG. 3 is a greatly enlarged cross-sectional view of a coaxial cable, according to one embodiment of the present invention.

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. In the drawings, the thickness of layers and regions may be exaggerated for clarity. Like numbers refer to like elements throughout.

Referring now to FIGS. 1–4, a multi-jacketed coaxial cable 10 for underground service, according to the present invention, is illustrated. The cable 10 generally comprises an elongate center conductor 12, cladding 13 surrounding the center conductor, a surrounding dielectric material 14 such as a foamed polymer dielectric, an outer conductor 16, a first jacket 18, an intermediate protective layer 20, and a second jacket 22. While a double-jacketed coaxial cable 10 is illustrated and described hereinbelow, the coaxial cable of the present invention can include additional protective jackets, typically separated by additional intermediate layers, in order to further increase the strength and protection provided by the coaxial cable of the present invention.

Preferably, a ripcord 33 is positioned longitudinally between the first jacket 18 and the intermediate protective layer 20 to facilitate removal 35 of both the intermediate protective layer and the second jacket 22. Preferably a tracer 35, or other visible indicia, extends longitudinally along the outer surface **22*b* of the second jacket 22 to facilitate locating the underlying ripcord 33**.

While shown as an underground installation, the coaxial cable according to the present invention could also be aerially installed, without departing from the spirit and scope of the present invention. Also, the multi-jacketed coaxial according to the present invention, could be either a T&D cable or a coaxial drop cable without departing from the spirit and scope of the present invention.

Preferably, the center conductor 12 is formed from an electrically conductive metal or alloy such as steel, copper, or aluminum. In the illustrated embodiment, only a single inner conductor 12 with cladding 13 is shown, as this is the arrangement most commonly used for coaxial cables of the type used for transmitting RF signals, such as television signals. However, the present invention is applicable to coaxial cables having more than one inner conductor.

The dielectric material 14 closely surrounding the center conductor 12 is a low loss dielectric. Preferably, the dielectric material 14 is formed from a thermoplastic foamable polymer in order to reduce the mass of the dielectric per unit length, and hence, reduce the dielectric constant. Particularly suitable materials are polyolefins such as low and high density polyethylene and polypropylene, and fluoropolymers, such as fluorinated ethylenepropylene (FEP) polymer or a perfluoro alkoxy copolymer (PFA). See U.S. Pat. No. 4,894,488 to Gupta, assigned to the assignee of the present invention, and incorporated herein by reference in its entirety.

Closely surrounding the dielectric material 14 is an outer conductor 16. In one embodiment, the outer conductor 16 can be a solid metallic shield. The outer conductor 16 of this embodiment is preferably both electrically and mechanically continuous. Mechanically continuous means that the outer conductor 16 is continuous in both its longitudinal and circumferential extent and at least partially seals the cable against ingress of contaminants such as moisture. Electrically continuous means that the outer conductor 16 is electrically conductive throughout its longitudinal and circumferential extent and at least partially seals the cable against leakage of RF radiation, either in or out.

In another embodiment, the outer conductor 16 is comprised of two separate elements: a metallic shielding foil (not shown) which surrounds the dielectric material 14, and an open wire braid (not shown) surrounding the metallic shielding foil. The foil may be formed of various electrically conductive metals, such as copper or aluminum. Particularly preferable is aluminum in a fully annealed condition, typically referred to as "O" temper aluminum.

Preferably, the inner surface **16*a* of the outer conductor 16 is continuously bonded along its length and about its circumferential extent to the outer surface 14*b* of the dielectric material 14 by the use of a thin layer of adhesive (not shown). A preferred type of adhesive for this purpose is a random copolymer of ethylene and acrylic acid (EAA). In order to avoid adversely affecting the electrical characteristics of the cable, the thickness of the adhesive layer is preferably 1 mil or less. The wire braid typically comprises a plurality of relatively small diameter round wires having a predetermined interlacing helical lay pattern around the shielding foil which permit the cable to retain flexibility while providing reinforcement to the underlying shielding foil. The shielding foil typically surrounds the dielectric material 14 such that the overlapping edge portions form a longitudinal seam. However, as would be understood by those having skill in the art, the outer conductor 16** may have alternative embodiments including seamless, swaged aluminum tube.

Closely surrounding the outer conductor 16 is a first jacket 18. Preferably, the first jacket 18 is made from polyethylene; however, other suitable polymeric materials may be used including polyvinyl chloride, polyurethane, and rubber. The first jacket 18 may be bonded to the outer surface **16*b* of the outer conductor 16. This is typically accomplished by depositing a thin layer of adhesive (not shown), such as EAA, to the outer surface 16*b* of the outer conductor 16 and applying the first jacket 18 by any suitable method, such as extrusion coating. Optionally, a flooding compound (not shown) may be placed between the first jacket 18 and the outer conductor 16** to further inhibit moisture ingress.

Closely surrounding the first jacket 18 is an intermediate protective layer 20. Preferably, the intermediate protective layer 20 is relatively thin, having a thickness of only a few thousandths of an inch (mils). The intermediate protective layer 20 may be comprised of various materials, but should have a melting temperature greater than the melting temperature of the second jacket 22 and preferably a melting temperature greater than the respective melting temperatures of both the first jacket 18 and the second jacket 22 (described fully below). Accordingly, the second jacket 22 may be extruded around the intermediate protective layer 20 without damaging or melting the intermediate protective layer. The intermediate protective layer 20 also acts as a heat shield to protect the first jacket 18 from damage or melting during the extrusion of the second jacket 22.

Preferably, the intermediate protective layer 20 is formed of a material having a greater strength than either the first or second jackets 18, 22 so as to increase the cut-through resistance and impact resistance of the cable. Therefore, the coaxial cable may be installed in rugged environments, such as rocky terrain as shown in FIG. 1, without cutting the cable or adversely affecting the performance of the coaxial cable. The preferred material for the intermediate protective layer 20 is polyester, such as MYLAR® Polyester (a registered trademark of the E.I. DuPont Company, Wilmington, Del.). However, the intermediate protective layer can be comprised of other relatively strong materials having an appropriate melting temperature without departing from the spirit and scope of the present invention.

Figure 6:
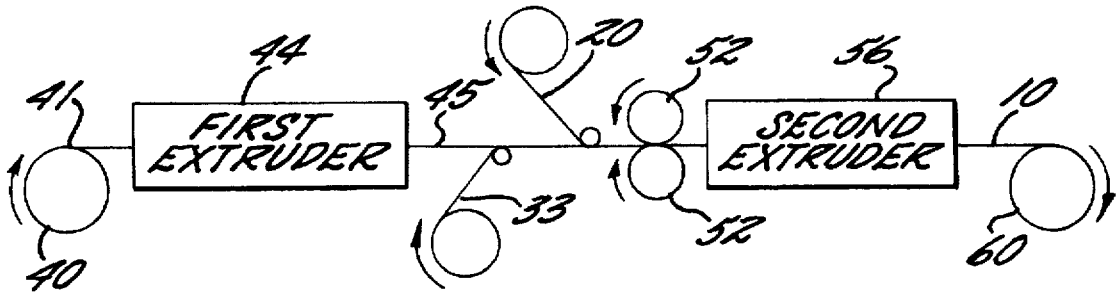
FIG. 6 is a schematic diagram of a method of making a coaxial cable, according to one embodiment of the present invention.

In one embodiment illustrated schematically in FIG. 6, the intermediate protective layer 20 is applied to the first jacket 18 as a tape and is then wrapped around the first jacket, producing a layer having a longitudinal seam along the cable. Alternatively, the intermediate protective layer 20 may be extruded about the first jacket 18, thereby producing a seamless layer. The thickness of the extruded intermediate protective layer 20 is preferably less than a predetermined maximum thickness such that a ripcord would be able to longitudinally separate the intermediate protective layer, as discussed fully below. Additionally, a thin adhesive layer 21 may be applied to the outer surface **20*b* of the intermediate protective layer 20 for securing the second jacket 22** to the intermediate protective layer.

Closely surrounding the intermediate protective layer 20 is a second jacket 22. Typically, the first and second jackets 18, 22 are comprised of the same polymeric material, such as a medium density polyethylene (MDPE). In addition, the first and second jackets 18, 22 generally have the same thickness, such as 0.035 inches (35 mils). However, as would be understood by those having skill in the art, the first and second jackets 18, 22 may be comprised of different materials and may have different thicknesses, as desired.

The second jacket 22 serves as a sacrificial layer to directly contact environmental hazards, while protecting the primary coaxial cable beneath the intermediate layer 20. As used herein, the term "primary coaxial cable" refers to the center conductor 12, the dielectric material 14, the outer conductor 16 and the first protective jacket 18. Accordingly, rocks, glass, or other sharp objects can cut the second jacket 22 without cutting the intermediate layer 20 or the primary coaxial cable. In addition, the second jacket 22 and intermediate layer 20 may at least partially cushion the primary coaxial cable from impacts, such as from a shovel. Accordingly, the combination of intermediate layer 20 and second jacket 22 protects the primary coaxial cable.

Preferably, a tracer 35, or other visible indicia, is provided on the outer surface **22*b* of the second jacket 22 and extends longitudinally to identify the location of the underlying ripcord 33. Other visible indicia may be used in lieu of an extruded tracer, such as a stripe of paint having a different color than the second jacket 22, or raised portions such as bumps or ridges. The tracer 35, or other visible indicia, need not directly overlie the ripcord 33, but may indicate the relative location of the underlying ripcord by being in a predetermined positional relationship. The ripcord 33 is preferably made from NYLON® (a registered trademark of the E.I. DuPont Company, Wilmington, Del.). However, as would be understood by those having skill in the art, other materials suitable for stripping back the outer jacket 22 and intermediate protective layer 20** may be used.

A method of making multi-jacketed coaxial cable according to the present invention is illustrated in FIG. 6. A coaxial cable core 41 comprising a center conductor 12 surrounded by dielectric material 14, which, in turn, is surrounded by an outer conductor 16, may be premanufactured and supplied from a suitable supply reel 40 to the first extruder 44 located downstream. The first extruder 44 continuously extrudes a first jacket 18 around the cable core 41. Thus, in one advantageous embodiment, the resulting product leaving the first extruder 44 is a standard size coaxial cable 45.

In another embodiment, forming means (not shown) for the coaxial cable core 41 may be provided upstream of the first extruder 44 and operated in-line and continuously with the first extruder so as to do all steps sequentially. As would be understood by those having skill in the art, flooding compounds also may be applied between the outer conductor 16 and the first jacket 18.

Downstream from the first extruder 44, a continuous ripcord 33 is applied longitudinally along the outer surface 18*b* of the first jacket 18 of the advancing coaxial cable 45. After applying the ripcord 33, an intermediate protective layer 20 is formed about the outer surface 18*b* of the first jacket 18. In the illustrated embodiment, forming rolls 52 wrap a tape of the second material around the coaxial cable 45 and ripcord 33 to thereby form the intermediate protective layer 20. Preferably, the tape forming the intermediate protective layer 20 of this embodiment is wrapped so that the longitudinal edges overlap to produce a seam directly over the underlying ripcord 33. Alternatively, the intermediate protective layer 20 can be extruded about the coaxial cable 45 and the ripcord 33 as described above.

Downstream from the forming rolls 52, a second extruder 56 applies a second jacket 22 to the outer surface 20*b* of the intermediate protective layer 20. Accordingly, the second jacket 22 may be extruded around the intermediate protective layer 20 without damaging or melting the intermediate protective layer. The intermediate protective layer 20 also acts as a heat shield to protect the first jacket 18 from damage or melting during the extrusion of the second jacket 22.

Preferably, a tracer 35, or other visible indicia, is extruded concurrently with the extrusion of the second jacket 22 so as to overlie the longitudinally extending ripcord 33. Alternatively, the tracer 35, or other visible indicia, may be applied subsequent to the extrusion of the second jacket 22. The assembled multi-jacketed coaxial cable 10 comprising an intermediate protective layer 20, optional ripcord 33, and tracer 35 is then directed to a take-up reel 60.

Figure 4:
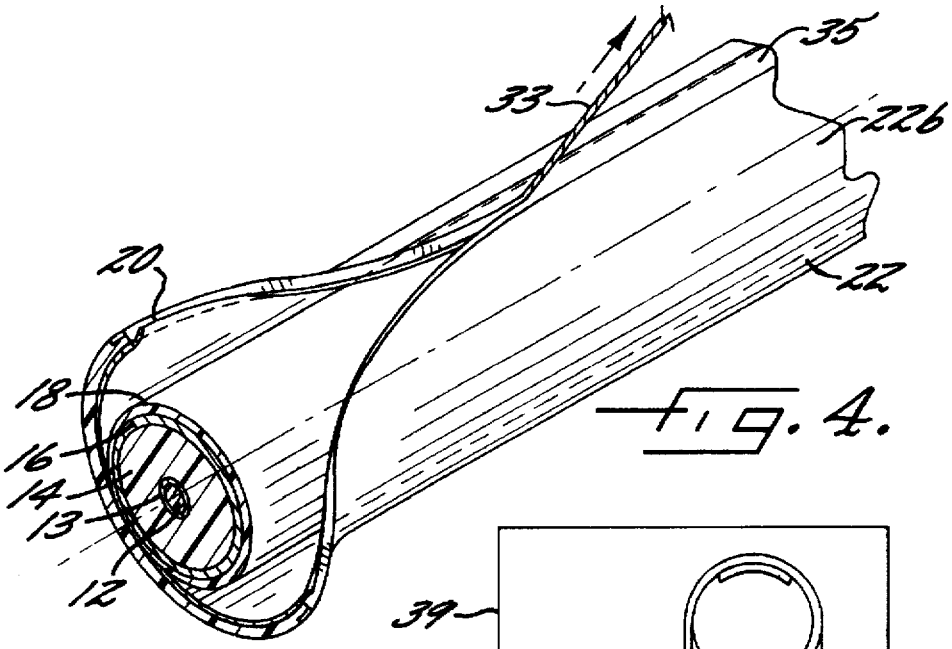
FIG. 4 is perspective view of a coaxial cable, according to one embodiment of the present invention, illustrating the removal of an intermediate layer and a second jacket.

Referring now to FIG. 4, to mount a connector (not shown) to an end portion of the multi-jacketed coaxial cable 10, the second jacket 22 and the intermediate protective layer 20 are stripped back from the end portion of the cable and the connector, such as a conventional jacket-gripping connector, is mounted to end portions of the exposed cable. In order to facilitate the removal of the second jacket 22 and the intermediate protective layer 20, the longitudinally extending ripcord 33 is preferably disposed between the first jacket 18 and the intermediate protective layer. By pulling the ripcord 33 longitudinally along the cable 10, the second jacket 22 and the intermediate protective layer 20 are longitudinally separated and may be removed from the end portion of the cable. In order to facilitate the pulling of the ripcord 33, the ripcord preferably underlies the seam formed by the overlapping longitudinal edges of the intermediate protective layer 20 such that the seam opens when the ripcord is pulled.

Preferably, a tracer 35 extending longitudinally along the outer surface 22*b* of the second jacket 22 is aligned with the underlying seam of the intermediate protective layer 20 and the ripcord 33. A field technician can, therefore, readily locate the ripcord 33 and remove the second jacket 22 and the intermediate protective layer 20 as desired.

Figure 5:
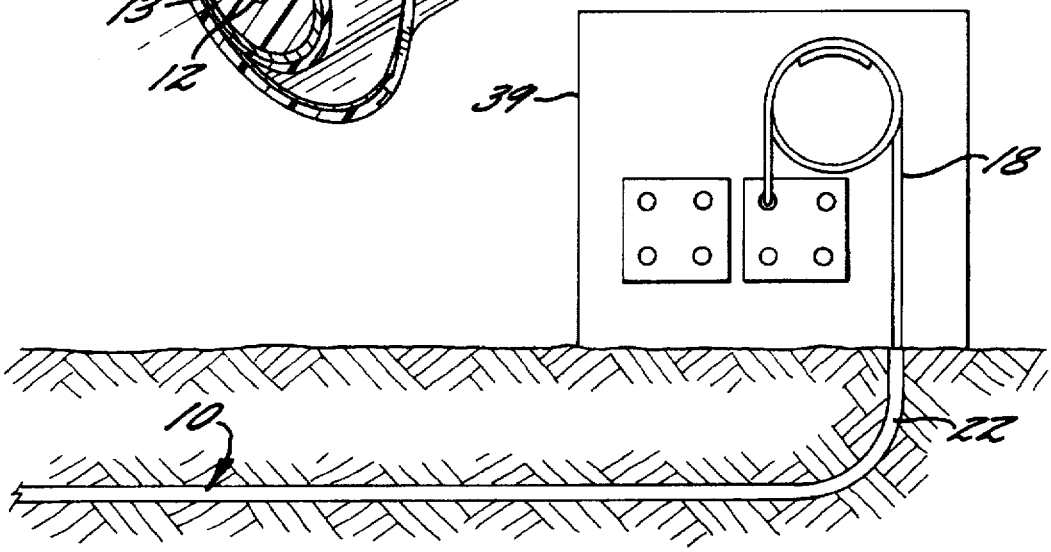
FIG. 5 illustrates a coaxial cable directly in the ground and terminating within an electrical junction box, such as a pedestal.

The second jacket 22 and the intermediate protective layer 20 may also be stripped back and removed from other portions of the multi-jacketed coaxial cable 10 in order to increase the flexibility of those portions of the cable. For example, the second jacket 22 and the intermediate protective layer 20 may be removed from the portion of a coaxial cable 10 which extends upwardly from the ground into a pedestal or vault 39 to facilitate flexing of the coaxial cable within the pedestal or vault, as illustrated in FIG. 5. A boot can be installed on the connectorized end portion of the cable to further protect the end portion of the cable. In the embodiment illustrated in FIG. 5, the second jacket 22 and the intermediate layer 20 can be cut flush with each other.

The multi-jacketed coaxial cable 10, according to the present invention, is a tougher coaxial cable than conventional single-jacketed coaxial cable. It can better withstand the rigors of installation and the rigorous underground environment of both direct burial and indirect burial within a conduit. The ease of removal of the second jacket 22 and intermediate protective layer 20 provides desired flexibility, not only at the end of the cable 10, but also in medial portions of the cable where it may be desirable to bend the cable. Furthermore, the multi-jacketed feature provides increased resistance to moisture ingress and provides increased resistance to abrasion and other frictionally induced damage which may result from pulling the cable through a conduit. Additionally, the overall structural integrity of the multi-jacketed cable 10 is increased by the addition of the intermediate layer 20 and second jacket 22. Higher tensile stresses from pulling may be withstood, as compared with conventional coaxial cable, without causing damage to the cable. The intermediate protective layer 20 also increases the toughness of the cable and makes the cable more resistant to cut-through damage caused by foreign objects.

For example, a double-jacketed coaxial cable 10, according to one embodiment of the present invention, having a 0.001 inch thick (1 mil) MYLAR Polyester intermediate protective layer 20, has approximately 3.5 times the normal impact and cut-through resistance of a standard, single-jacketed coaxial cable. Further, under a "knife-edge compression test", a double-jacketed coaxial cable 10, according to one embodiment of the present invention, having a 0.002 inch thick (2 mil) MYLAR Polyester intermediate protective layer 20 and 0.035 inch thick (35 mils) first and second jackets 18, 22 is capable of withstanding a compressive force at least 4 times that of a standard, single-jacketed coaxial cable having a 0.035 inch thick (35 mils) outer jacket. As known by those having skill in the art, the "knife-edge compression test" is performed by determining the compressive force required to force a knife edge through the protective jacket of a coaxial cable and into contact with the outer conductor. The knife edge is typically applied at an angle, and the compressive force required to penetrate the outer jacket and contact the outer conductor is measured. In the above example, a 0.010 inch thick (10 mil) knife edge was applied to a double-jacketed coaxial cable 10, as described above, at an angle of 20° relative to the longitudinal axis of the cable.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. A coaxial cable comprising:

at least one elongate conductor;

a dielectric material surrounding and adjacent said at least one elongate conductor;

an outer conductor surrounding and adjacent said dielectric material; and a composite protective jacket comprising:

an inner protective layer of a first polymeric material surrounding and adjacent said outer conductor;

an intermediate layer of a second polymeric material surrounding and removably adjacent said inner protective layer; and an outer protective layer of a third polymeric material surrounding and adjacent said intermediate layer;

wherein the second polymeric material has a higher melting temperature than the third polymeric material, such that the first and third polymeric materials of the inner and outer protective layers, respectively, form distinct separate phases from each other.

2. A coaxial cable according to claim 1, wherein the second material is polyester.

3. A coaxial cable according to claim 2, wherein the second polymeric material has an impact resistance greater than the impact resistance of the first and third polymeric materials.

4. A coaxial cable according to claim 1, wherein the first and third materials are the same.

5. A coaxial cable according to claim 4, wherein the first and third materials are polyethylene.

6. A coaxial cable according to claim 1, wherein the impact resistance of the second material is greater than the impact resistance of the first and third materials to thereby further protect said at least one elongate conductor, said outer conductor, and said dielectric material from damage.

7. A coaxial cable according to claim 1, wherein said composite jacket further comprises an adhesive layer disposed between said intermediate layer and said outer layer.

8. A coaxial cable according to claim 1, wherein said intermediate layer comprises opposing first and second longitudinal edge portions overlapping to define a longitudinally extending seam.

9. A coaxial cable according to claim 8, further comprising a longitudinally extending ripcord to facilitate the removal of said intermediate layer and said outer protective layer, said ripcord disposed between said inner protective layer and said intermediate layer and aligned with the longitudinally extending seam of said intermediate layer.

10. A coaxial cable according to claim 9, wherein said outer layer further comprises visible indicia for indicating the position of said ripcord, said visible indicia extending longitudinally along an outer surface of said outer layer.

11. A coaxial cable comprising:

at least one elongate conductor;

a dielectric material surrounding and adjacent said at least one elongate conductor;

an outer conductor surrounding and adjacent said dielectric material;

a composite protective jacket comprising:

an inner protective layer of a first polymeric material surrounding and adjacent said outer conductor;

an intermediate layer comprised of a second polymeric material surrounding and removably adjacent said inner protective layer, said intermediate layer having opposing first and second longitudinal edge portions overlapping to define a longitudinally extending seam; and an outer protective layer of a third polymeric material surrounding and adjacent said intermediate layer, wherein the impact resistance of the second material is greater than the impact resistance of the first and third materials to thereby further protect said at least one elongate conductor, said outer conductor and said dielectric material from damage; and a longitudinally extending ripcord to facilitate the removal of said intermediate layer and said outer protective layer, said ripcord disposed between said inner protective layer and said intermediate layer and aligned with the longitudinally extending seam of said intermediate layer.

12. A coaxial cable according to claim 11, wherein the second material has a higher melting temperature than the third material, such that the first and third materials of the inner and outer protective jackets, respectively, form distinct separate phases from each other.

13. A coaxial cable according to claim 11, wherein the second material is polyester.

14. A coaxial cable according to claim 11, wherein the first and third materials are the same.

15. A coaxial cable according to claim 14, wherein the first and third materials are polyethylene.

16. A coaxial cable according to claim 11, wherein said composite jacket further comprises an adhesive layer disposed between said intermediate layer and said outer layer.

17. A coaxial cable according to claim 11, wherein said outer layer further comprises visible indicia for indicating the position of said underlying ripcord, said visible indicia extending longitudinally along an outer surface of said outer layer.

18. A method of producing a coaxial cable comprising the steps of:

advancing a coaxial cable core along a path of travel, the coaxial cable core comprising at least one elongate conductor, a dielectric material surrounding and adjacent the at least one elongate conductor, and an outer conductor surrounding and adjacent the dielectric material;

forming an inner protective layer of a first polymeric material around and adjacent the advancing coaxial cable core;

disposing a ripcord longitudinally along an outer surface of the inner protective jacket;

forming a removable intermediate layer of a second polymeric material around and adjacent the inner protective layer and the longitudinally disposed ripcord;

forming an outer protective layer of a third polymeric material around and adjacent the intermediate layer; and shielding the inner protective layer from excessive heat during said step of forming an outer protective layer by using an intermediate protective layer having a higher melting temperature than the melting temperature of the outer protective layer, such that the inner and outer protective jackets form distinct separate phases from each other.

19. A method according to claim 18, wherein said step of forming a removable intermediate layer comprises the step of wrapping a tape of the second material around and adjacent to the inner protective layer and the longitudinally disposed ripcord to thereby form a removable intermediate layer, wherein the second material has opposing longitudinal edge portions, and wherein said wrapping step comprises the step of overlapping the opposing longitudinal edge portions to define a longitudinally extending seam aligned with and overlying the ripcord.

20. A method according to claim 18, wherein said step of forming a removable intermediate layer comprises the step of extruding the intermediate layer about the inner protective layer.

21. A method according to claim 18, wherein said step of forming an inner protective layer comprises extruding the inner protective layer about the coaxial cable core.

22. A method according to claim 18, wherein said step of forming an outer protective layer comprises extruding the outer protective layer about the intermediate protective layer.

23. A method according to claim 18, further comprising the step of forming visible indicia on the outer surface of the outer protective layer for indicating the position of the underlying ripcord.

* * * * *